United States Patent [19]

Gilman

[11] Patent Number: 4,686,604

[45] Date of Patent: Aug. 11, 1987

[54] BISTABLE RELAY CIRCUIT

[76] Inventor: Bernard S. Gilman, 484 Laurel Rd., Rockville Center, N.Y. 11570

[21] Appl. No.: 866,700

[22] Filed: May 27, 1986

[51] Int. Cl.[4] ..... H01H 47/00; H01H 47/32; H01H 47/14

[52] U.S. Cl. ..... 361/155; 361/168.1; 361/194

[58] Field of Search ..... 361/167, 168.1, 194, 361/155, 191

[56] References Cited

U.S. PATENT DOCUMENTS 3,264,499 8/1966 Moser et al. ..... 361/168.1

*Primary Examiner*—L. T. Hix
*Assistant Examiner*—David Porterfield
*Attorney, Agent, or Firm*—Erwin S. Teltscher

[57] ABSTRACT

A bistable relay circuit adapted to be operated from a two polarity supply of a predetermined voltage, includes a control relay having a coil exhibiting hysterisis, and at least a first single pole, double throw switch, having one pole contact and two non-pole contacts. The control relay coil has a resistance value which is low compared to the resistance value of the first resistor, while a current operatively flowing therethrough is insufficient on its own to energize the control relay. A first resistor is in series with the coil of the control relay. The series combination of the control relay coil and of the first resistor are connected to the power supply. A steering relay has a coil and at least a second single pole, double throw switch, having one pole contact and two non-pole contacts. A single pole, single throw switch is in series with the coil of the steering relay. The series combination of the steering relay coil and the single pole, single throw switch is connected to the power supply. A second resistor is connected to the pole contact of the first switch, and to one of the non-pole contacts of the second switch, and a capacitor is connected to the pole of the second switch and to one polarity of the power supply.

4 Claims, 3 Drawing Figures

BISTABLE RELAY CIRCUIT

FIELD OF THE INVENTION

The present invention relaties to a circuit of achieving what is usually referred to as bistable operation of a relay. In bistable operation, application or removal of power will lock up a relay in a maintained "make" mode and re-application or removal of power will return the relay to a maintained "non-make" mode. As indicated, in bistable operation, power or initiating power or a signal must be either applied twice or removed twice to change the operational modes of the relay from make to non-make, or vice versa.

BACKGROUND OF THE INVENTION

There are presently several methods of achieving bistable operation. Descriptions of their operational methods are as follows:

A—Latching Method:

1—Two relays are mounted adjacently, each having a latching bar that engages with each other. When relay "A" is energized, the latch bar locks up relay "B" in a non-energized mode, and remains that way whether power to relay "B" is maintained or removed. Conversely, when relay "B" is energized, the latch bar locks up relay "A" in a non-energized mode, and remains that way whether power to relay "B" is maintained or removed.

B—Detent Method:

1—In a detent type, a single relay is used with the armature engaged to a split point detent which has a lateral motion to one side or the other with each full excursion of the armature. When the relay is energized, the excursion of the armature moves the detent to one side and it remains in that position. When the power to the relay is released and then re-energized, the excursion of the armature moves the detent to the other side, and it remains in that position. Each time the relay is energized, the detent alternates and holds from one side to the other. By means of a linkage or of an actuating arm or of an eccentric cam, the alternate motion of the detent is used to make or release contacts on the relay.

C—Ratchet and Pawl Method:

In this method, a single relay is used. The armature is involved directly, or through linkage to a pawl which engages a ratchet gear on a shaft. When the relay is energized, the excursion of the armature can be made to either cause a rotation of the shaft, or the rotation of the shaft can occur when the relay is de-energized. By means of alinkage or of an actuating arm or of a cam, the rotation of the ratchet shaft is used to maintain contacts in a make or non-make mode each time the relay is energized or de-energized.

D—Magnetic Method:

1—Magnetic types can be made in single relay or dual relay operation. In the single relay version, a permanent magnet is mounted on the pole piece. The magnetic force of the magnet is sufficient to maintain the armature in an energized position once the relay is energized, but has insufficient magnetic force to energize the relay on its own. In operation, full DC power is supplied to the relay coil to seat the armature. When power is removed, the magnet retains the armature in a seated position, and holds the contacts in a make mode. To release the armature, DC voltage is applied in reverse polarity and at a critical power level that is just sufficient to overcome only the magnetic hold of the magnet, so that the armature releases and the contacts return and hold in a non-make mode.

2—In the magnetic two relay type, two relays face each other with a permanent magnet bar interface having sufficient magnetic force to hold a pivoted common armature for each relay in an energized position on the relay that is energized. The single armature is pivoted between each relay so that when one side of the armature closes on one relay, it will open on the other relay. When sufficient power is applied to one relay coil, the armature will close and remain closed on that relay by the magnetic force of the permanent magnet even when power is removed. When sufficient power is applied to the second relay, the armature will close on the second relay and release the armature of the first relay and the second relay will remain and hold in closed position by the magnetic force of the permanent magnet, even if the power is removed. The rocking motion of the armature due to the closing and opening of each relay is made use of by means of shaft, linkage or operating arm to alternately hold the contacts in either a make or a non-make mode.

E—Electronic Method:

1—The electronic type uses solid state circuitry to place a relay in a make or non-make (release) mode. The circuitry usually consists of integrated circuits (I.C.'s) and/or transistors (PNP's, NPN's, and/or SCR's, etc.) depending on the design. In electronic units, applied power remains on at all times to supply the circuitry, and the make or non-make mode of the relay is controlled and alternated by each opening or each closing of an external control switch, which is applied to the control circuitry of the relay. In the opening switch type, with power applied, the closing of the external switch causes no change in the initial mode of the relay, which is in a non-energized state. Upon opening of the external switch, the relay becomes energized and remains in that state until the external switch is again closed, and then re-opened at which time the relay returns to the non-energized state and remains in that state until the aforegoing cycle of the external switch is repeated.

SUMMARY OF THE INVENTION

The present invention is a unique electrical device employing circuitry that achieves bistable operation (or alternating relays or alternator or other applicable terminology) with mode change with each opening (or by circuitry modification—with each closing) of an external switch without in a preferred embodiment thereof requiring the the use of any I.C.'s and/or any discrete semi-conductor switching device involved in its control circuitry. With each change of mode induced by an external switch to its control circuitry, the relay contacts make or break for purposes of controlling external circuitry or equipment to which the bistable relay is applied. Its bistable operation is not achieved mechanically by a ratchet and pawl, or cams, or detents, or latches, or magnets or any other equivalent mechanical devices or methods.

Bistable relays using I.C.'s and/or discrete semi-conductor switching devices, can and have falsely transferred (relay is energized) when an input voltage is initially applied, due to dV/dt problems of certain switching semi-conductors. Such false transfer occurrences, even if rare, can and have caused field and application problems of a minor or serious nature to equipment and functions of equipment or external control circuitry. Bistable relays using I.C.'s and/or discrete semi-conductor switching devices are also very sensitive to transients which can result in catastrophic failure of the I.C.'s or discrete semiconductor switching devices. Protective circuitry or components can be additionally incorporated within the functional circuitry to limit the catastrophic effects of transients. However, present transient protective devices such as MOV's (metal oxide varistors) can only take a limited number of "hits" after which their protective capabilities are sharply curtailed. Some other suppression devices do not react quickly enough to provide adequate suppression of transients having very sharp or fast rise times.

BRIEF DESCRIPTION OF THE DRAWING

The invention will be better understood with the aid of the drawing, in which.

DESCRIPTION OF THE PREFERRED EMBODIMENTS

The circuitry and method of operation of the present invention together will now be described as follows: (see FIG. 1) Terminals "A" and "B" serve for the connection to a supply voltage having alternating (AC) or direct current (DC) values. With AC voltages, a suitable (non-illustrated) rectifier and filter is incorporated into the circuitry, to supply DC to the circuit as the preferential voltage. Relay K-2 is the control relay to be operated in a bistable manner. One set of contacts of relay K-2, acting as a single pole, double throw switch, and having a pole contact $P_2$ and two non-pole contacts $NP_{2a}$ and $NP_{2b}$ is shown which are used in its bistable operation. Other (non-illustrated) set(s) of contacts of control relay K-2 are available for external control of other circuitry or equipment in the manner of which it is to be applied. A relay K-1 is a small SPDT supplemental or steering relay, or other SPDT switching device. The basic circuitry is shown in FIG. 1.

Figure 1:
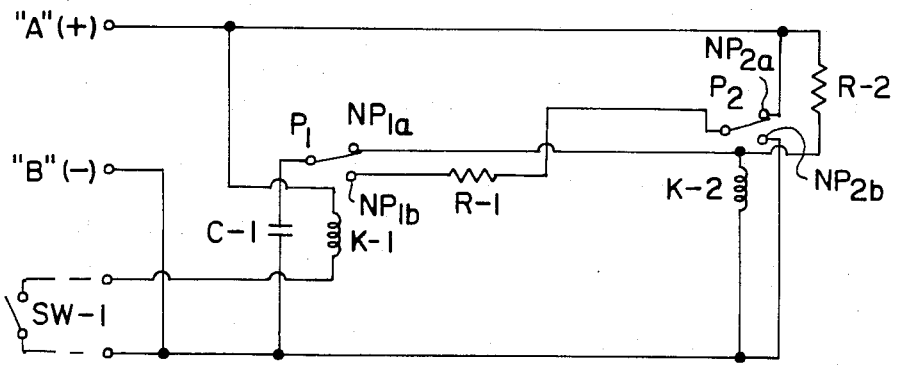
FIG. 1 is a circuit diagram of a first embodiment of a bistable circuit, according to the present invention.

Referring to FIG. 1, and with voltage applied to terminals "A" and "B" and switch SW-1 in either open or closed position, control relay K-2 will remain in a non-energized mode.

Assuming SW-1 is initially open, then upon closing of a single pole, single throw SW-1, control relay K-2 will remain in a non-energized mode. Upon opening the switch SW-1, the control relay K-2 will become energized and remain in an energized mode. Upon thereafter closing SW-1, the control relay K-2 remains energized and upon a subsequent opening of the switch SW-1, control relay K-2 is de-energized and remains in a non-energized mode. This alternate switching of modes of the control relay K-2 is repeated with each opening of of the switch SW-1. The opening or closing of the switch SW-1 can be of either short duration or sustained.

Figure 2:
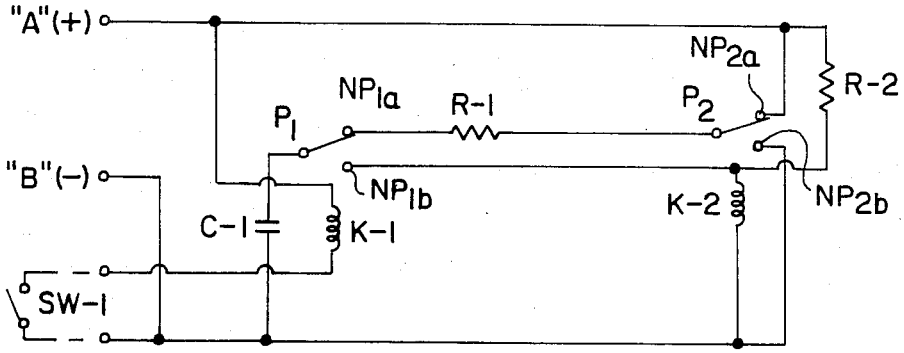
FIG. 2 is a circuit diagram of a modified version of the circuit diagram of FIG. 1.

Assuming switch SW-1 is initially closed, the control relay K-2 will remain in a non-energized mode. Upon opening switch SW-1, the control relay K-2 will become energized and remain in an energized mode. Thereafter, the mode of the control relay K-2 will change with each opening of of the switch SW-1 as described above. The circuitry can also be modified (as described below) so that the mode of the control relay K-2 is changed with each closing of the switch SW-1 (see FIG. 2)

The function and description of the circuitry is as follows: K-1 is a supplemental or steering relay having SPDT contacts or any similar device having SPDT contacts, referred to as $P_1$, $NP_{1a}$, and $NP_{1b}$. K-2 is functional bistable control relay with one set of its contacts (referred to as $P_2$, $NP_{2a}$, and $NP_{2b}$ used for its control, and the other set(s) of (nonillustrated) contacts for control of external circuitry or equipment in the manner of which it is to be applied. C-1 is a storage capacitor. R-1 is a resistor to limit current in charging and in discharging capacitor C-1. Resistor R-2 is a bias resistor whose value is chosen so as to apply a bias voltage to the coil of control relay K-2 that is insufficient on its own to energize K-2, but is of adequate value to retain K-2 in an energized mode after K-2 is energized by the momentary discharge of the capacitor C-1, as will be described later. The bias voltage also serves to reduce the storage requirements of capacitor C-1.

Upon application of the supply voltage at "A" and "B" and switch SW-1 open, the control relay K-2 is in a non-energized mode. Upon switch SW-1 being closed, the relay K-1 is energized and through its contacts $P_1$ and $NP_{1b}$, capacitor C-1 is charged to full supply voltage through contacts $P_1$ and $NP_{1b}$ and the contacts $P_2$ and $NP_{2a}$ of control relay K-2 with control relay K-2 remaining in the non-energized mode. Upon re-opening SW-1, the relay K-1 is de-energized, and through its contacts $P_1$ and $NP_{1a}$, the charge on capacitor C-1 is discharged through the coil of control relay K-2, which energizes K-2, and is kept in an energized mode by the bias voltage, or current flowing through the resistor R-2 and the coil of the control relay K-2. Upon re-closing of the switch SW-1, the relay K-1 is energized and through its contacts $P_1$ and $NP_{1b}$, any residual charge in capacitor C-1 is fully discharged to ground through contacts $P_2$ and $NP_{2b}$ of relay K-2. Upon re-opening switch SW-1, relay K-1 is de-energized, and through its contacts $P_1$ and $NP_{1a}$, the inrush of charging current through resistor R-2 to capacitor C-1 causes an additional voltage drop across resistor R-2, so that there is a momentary zero voltage at the coil of control relay K-2, causing K-2 to be de-energized and remain in a de-energized mode. The cycle is repeated with successive openings and closings of switch SW-1.

In the foregoing manner, control relay K-2 alternates mode with each opening of the switch SW-1. The same alternating modes of control relay K-2 can also be achieved by each closing of switch SW-1 by reversing the leads on the stationary contacts of relay K-1 (see FIG. 2).

Figure 3:
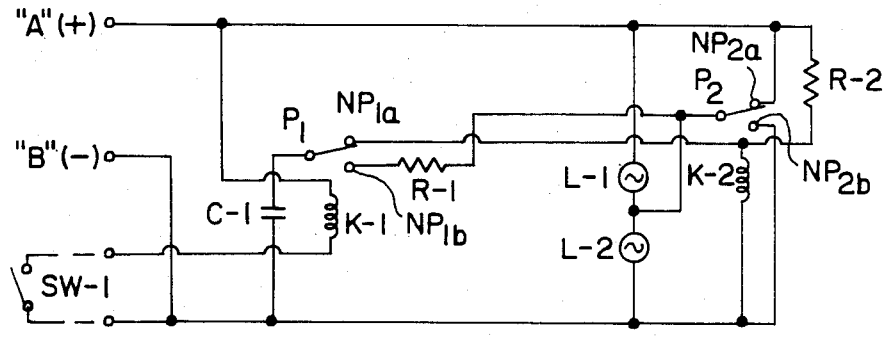
FIG. 3 is a circuit diagram corresponding to that of FIG. 1, but including an additional refinement in terms of visual indicator means.

In FIG. 3, two indicator lights L-1 and L-2 are added to give a visual indication of the mode status of control relay K-2.

In a representative, but not limiting embodiment of the present invention the supply voltage ranged from 30–33 Volts, the steering relay K-1 had a resistance of 3200 Ohm, its pull-in range being 20–25 Volts, the relay K-2 had a resistance of 800 Ohm, its pull-in range varied from about 16–18 Volts, its release voltage varied within a range of 5–6 Volts, R-2 was 2,400 Ohms, C-1 was 68 microfarads, R-1 was 27 Ohms, and the bias voltage developed across K-2 was 7.5–8.5 Volts.

Other circuitry considerations are possible employing the operational mode of the present invention.

I claim:

1. A bistable relay circuit adapted to be operated from a two polarity supply of a predetermined voltage, comprising in combination, a control relay having a coil, and at least first single pole, double throw switch means, having one pole contact and two non-pole contacts, a first resistor in series with said coil of said control relay, the series combination of said control relay coil and of said first resistor being connectable to said power supply, said control relay coil having a resistance value which is low compared to the resistance value of said first resistor, while a current operatively flowing therethrough is insufficient on its own to energize said control relay, a steering relay having a coil and at least second single pole, double throw switch means, having one pole contact and two non-pole contacts, single pole, single throw switch means in series with the coil of said steering relay, the series combination of said steering relay coil and said single pole, single throw switch means being connectable to said power supply, and a capacitor connected to the pole of said second switch means and to one polarity of said power supply, whereby (a) upon connection of said circuit to said power supply, and upon said single pole, single throw switch means being initially in an open position, said control relay is in a non-energized state, (b) upon said single throw switch means being subsequently closed, said steering relay changes to an energized state, said capacitor being thereby charged to said voltage, while said control relay remains in said non-energized state, (c) upon said single throw switch means being subsequently opened, said steering relay coil is de-energized, said capacitor discharges at least partly through said second switch means and said coil of said control relay to change said control relay to an energized state, and said control relay remains in said energized state by said current continuing to flow therethrough, (d) upon said single throw switch means being thereafter reclosed, said coil of said steering relay is re-energized, and any residual charge on said capacitor is further discharged through said first switch means, while (e) upon said single throw switch means being subsequently re-opened, said steering relay is de-energized, while said capacitor is recharged through said second switch means by a recharging current surge, said recharging current surge being selected to be sufficient to cause a momentary voltage drop of sufficient magnitude through said first resistor to cause said control relay to revert to said non-energized state.

2. The bistable relay circuit as defined in claim 1, further comprising visual indicator means connected to said pole of said first switch means and adapted to be connected to said power supply.

3. The bistable relay circuit as defined in claim 2, wherein said visual indicator means comprise a first indicator light connected to said pole of said first switch means and adapted to be connected to one polarity of said power supply, and a second indicator light connected to said pole of said first switch means, and adapted to be connected to the other polarity of said power supply.

4. The bistable relay circuit as defined in claim 1, further comprising a second resistor connected to the pole contact of said first switch means, and to one of said non-pole contacts of said second switch means.

* * * * *